US006477710B1

(12) United States Patent
Ojoyeyi

(10) Patent No.: US 6,477,710 B1
(45) Date of Patent: Nov. 12, 2002

(54) GARMENT FOR CONCEALING PATIENT MEDICAL APPLIANCES

(76) Inventor: Feyisayo Ojoyeyi, 334 Pierce St. NE., Minneapolis, MN (US) 55413-2512

( * ) Notice: Subject to any disclaimer, the term of this patent is extended or adjusted under 35 U.S.C. 154(b) by 120 days.

(21) Appl. No.: 09/584,164

(22) Filed: May 30, 2000

(51) Int. Cl.[7] ..... A41B 1/00; A41D 1/00

(52) U.S. Cl. ..... 2/69; 2/114; 2/247; 2/250; 2/254

(58) Field of Search ..... 2/114, 247, 250, 2/251, 252, 253, 254, 69

(56) References Cited

U.S. PATENT DOCUMENTS

| | | | | | |
|---|---|---|---|---|---|
| 2,087,780 | A | | 7/1937 | Powell | |
| 2,224,734 | A | | 12/1940 | Kopf | |
| 3,047,877 | A | * | 8/1962 | Palazzo | 2/253 |
| 3,772,708 | A | * | 11/1973 | Segelin | 2/253 |
| 4,004,294 | A | | 1/1977 | Pinch | |
| D266,625 | S | | 10/1982 | Herman | |
| 4,495,662 | A | * | 1/1985 | Miller | 2/211 |
| 4,718,124 | A | * | 1/1988 | Sawicki et al. | 2/114 |
| D311,805 | S | | 11/1990 | Hayko | |
| 5,048,122 | A | * | 9/1991 | Prieur | 2/111 |
| 5,142,702 | A | | 9/1992 | Piloian | |
| 5,165,115 | A | | 11/1992 | Stanislaw | |
| D332,342 | S | | 1/1993 | Dye et al. | |
| D336,968 | S | | 7/1993 | Russano | |
| D341,919 | S | | 12/1993 | Grimes | |
| 5,279,589 | A | | 1/1994 | Feldman | |
| D348,557 | S | | 7/1994 | Thomas | |
| D350,012 | S | | 8/1994 | Christy et al. | |
| D362,331 | S | | 9/1995 | Berger, II | |
| 5,509,147 | A | * | 4/1996 | Busquets | 112/441 |
| D381,488 | S | | 7/1997 | Small | |
| D385,386 | S | | 10/1997 | Lancaster | |
| 6,041,445 | A | * | 3/2000 | Davitt | 2/247 |

OTHER PUBLICATIONS

*Commercial Product #1*: Garment product for patients made and sold by various manufacturers in 1998 having an opening such as a slit for withdrawing a catheter, but opening is simply a hole that is visible when not in use.

*Commercial Product #2*: Patient garment sold in 1998 under name Special Clothes by Special Clothes, Inc. of East Harwich, Mass. Garment has opening for withdrawing a catheter but no inside pocket spaced below the opening for storing a medical appliance.

* cited by examiner

*Primary Examiner*—A Vanatta
*Assistant Examiner*—Robert H. Muromoto Jr.
(74) *Attorney, Agent, or Firm*—James V. Harmon

(57) ABSTRACT

A garment for concealing a medical appliance such as a central line that is connected to a patient has a hidden pocket for storing the appliance on an inside surface of the front of the garment. The pocket has connected side and bottom edges which secure the pocket to the garment. The pocket also has a free upper edge that is positioned in spaced relationship below an opening in the front of the garment. The medical appliance can be concealed within the pocket while connected to the patient and later, when it is to be deployed, can be withdrawn from the pocket, raised above the upper edge of the pocket and withdrawn through the opening which is unobstructed above the pocket. The garment can have a second concealed opening at a lower level on one side of the garment for enabling multiple medical appliances to be connected to the patient for simultaneous use and withdrawn through openings in the garment at two different elevations. The opening can be concealed by a zipper or a cover flap.

5 Claims, 3 Drawing Sheets

GARMENT FOR CONCEALING PATIENT MEDICAL APPLIANCES

FIELD OF THE INVENTION

This invention relates to garments such as daywear, hospital gowns and sleepers used for concealing medical appliances connected to a patient.

BACKGROUND OF THE INVENTION

Children are particularly self-conscious about medical appliances such as catheters, wires and the like that are connected to them. If ordinary clothing is used, whether in the hospital or at home, the tubes connected to the patient are often difficult for a healthcare worker or parent to reach. In addition, ordinary clothing or a nightgown is often uncomfortable and, with a catheter extending from the patient, the front of the garment must be left unbuttoned or unzipped which can cause the patient to feel chilly or uncomfortable. While garments have been provided in the past with an opening through which a catheter, for example, can be withdrawn, a visible opening draws attention to the patient's condition, which only adds to the patient's anxiety and contributes to a feeling of self-consciousness. Prior gowns often tended to make a medical appliance conspicuous, a major disadvantage since it increases the child's feeling of self-consciousness.

In view of these and other deficiencies, there exists a need for an improved garment that can be used by a variety of special needs patients who require a feeding tube, infusion tube or monitor such as an apnea monitor and which will conceal such medical appliances while connected to the patient so that the garment looks like an ordinary child's romper or sleeper and does not draw attention to the patient's medical condition.

Accordingly, the primary objective of the invention is to conceal a medical appliance that is connected to a patient by providing a garment in the nature of a gown or sleeper for a child, which looks like an ordinary garment and does not attract attention to the patient's medical condition nor expose the wires, catheters and other medical appliances that are connected to the patient yet allows easy access to such appliances when required.

Another more specific objective of the invention is to find a way of concealing a medical appliance and yet enable the appliance to be easily lifted from a hidden location inside and withdrawn without difficulty through a concealed opening in the garment.

Still another objective is to enable the medical appliances that are connected to a patient to be held in such a way by the garment that they can be accessed by a healthcare worker or parent by reaching into the garment from the outside.

These and other more detailed and specific objects of the present invention will be better understood by reference to the following figures and detailed description which illustrate by way of example of but a few of the various forms of the invention within the scope of the appended claims.

SUMMARY OF THE INVENTION

The invention provides a garment for concealing a medical appliance such as a central line or an electrical wire used for monitoring a patient's condition. The garment includes a hidden pocket on an inside surface of the front of the garment. The pocket is secured to the garment by connected side and bottom edges. The pocket also has a free upper edge that is positioned in spaced relationship below an opening in the front of the garment so that the medical appliance can be concealed within the pocket and later, when it is to be deployed, can be withdrawn from the pocket and then raised above the upper edge of the pocket and withdrawn through the opening which is in an unobstructed position above the pocket. The garment is typically provided with one or more concealed openings on the front of the garment and one or more openings at a lower level along one side of the garment for enabling multiple medical appliances to be connected to the patient for simultaneous use and withdrawn through openings at two different elevations in the garment. A cover or closure is preferably provided on the front of the garment to conceal the opening when not in use. The opening can be closed by a zipper or a flap that is held in place at its free end by means of a fastener such as Velcro®.

THE FIGURES

DETAILED DESCRIPTION OF THE INVENTION

Refer now to the figures wherein the same numerals refer to corresponding parts in the several views.

Figure 2:
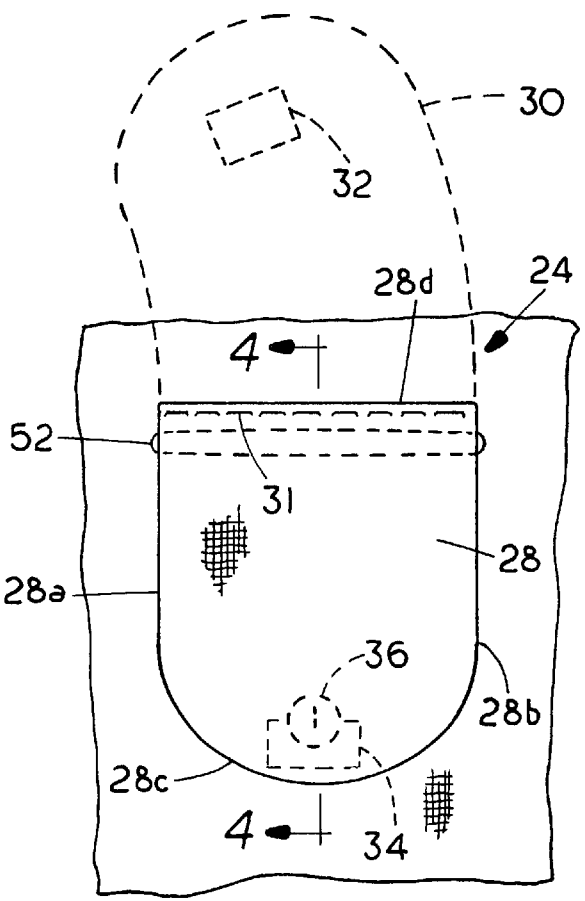
FIG. 2 is a partial front elevational view of one of the concealed openings in the garment of FIG. 1 on an enlarged scale.

While the invention has general application to a variety of hospital and regular garments, including garments for adults as well as children, it is particularly advantageous in connection with children's garments. Accordingly, the invention will be described by way of example in connection with a child's garment such as, in this case, a child's romper indicated generally at 10 in FIG. 1 with the understanding that the invention is not in any way limited to such use and can be applied as well to a variety of adult garments or to clothing used as daytime outerwear by children or adults. The child's romper 10 has a garment body with a front 12, arms 14 and legs 16 for a toddler or infant. The neck opening of the garment is shown at 18. On the front or breast portion of the garment 10 are provided a pair of similar pocket assemblies 24 and 26 in accordance with the invention. Since they are the same, only the pocket assembly 24 is shown in more detail in FIGS. 2 and 4. It includes a cover or flap 28 on the outside of the garment having a free portion **28*b* with a lower rounded edge 28*c* and an upper edge 28*d*** that is secured to the garment 10 by means of stitching 31. The flap 28 is shown in a raised position in dotted lines at 30 in FIGS. 2 and 4. At the free end of the flap 28 is a fastener 32, which in this cases comprises a hook-and-loop fastener such as a sheet of Velcro® that is connected when the flap is closed to a second piece of Velcro® 34 secured, e.g. by stitching, to the front panel 12 of the garment 10. While the flap 28 has been shown to be secured in place by means of Velcro® 32, 34, it can be held in place in any suitable manner in the closed position by means of other kinds of fasteners such as a button 36 (FIG. 2).

Figure 3:
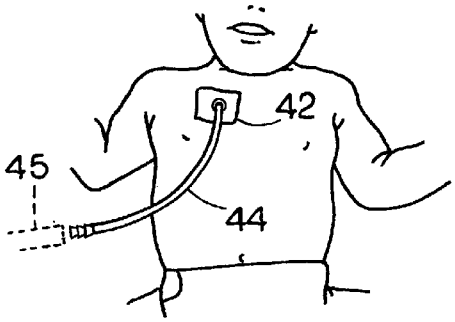
FIG. 3 is a partial front elevational view showing a medical appliance connected to a child patient with the garment removed for clarity.
Figure 4:
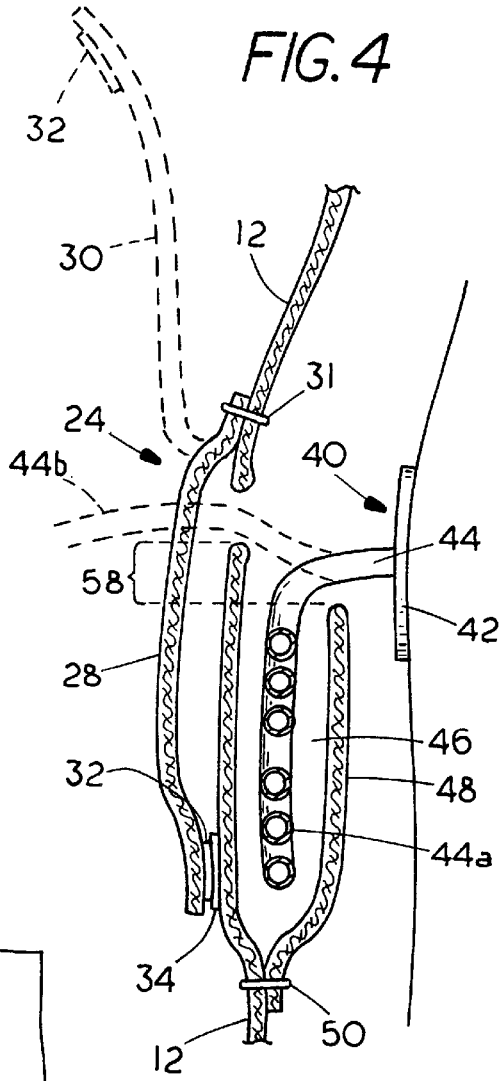
FIG. 4 is a vertical transverse sectional view taken on line 4—4 of FIG. 2 on a slightly enlarged scale.
Figure 5:
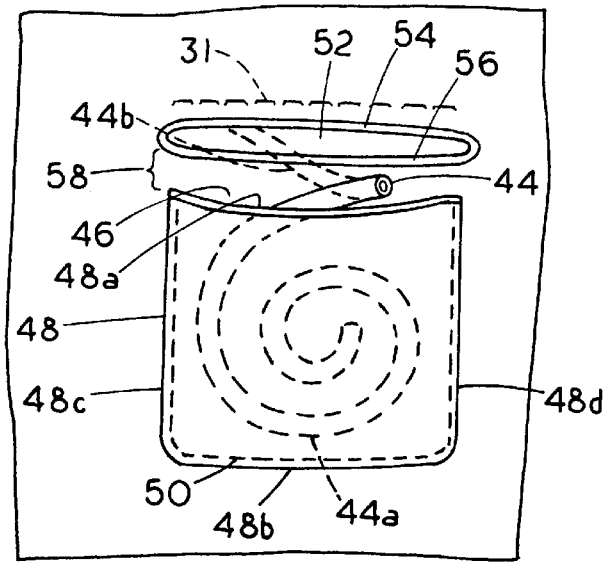
FIG. 5 is an inside view of the opening and concealed pocket of FIGS. 1, 2 and 4.

Secured to the patient (FIGS. 3 and 4) with the aid of adhesive patch 42 is a medical appliance 40, in this case a Hickman catheter 44 that extends from the front of the patient's body. FIG. 3 shows the patient with a catheter 44 surgically connected to the upper portion of the chest and held in place by an adhesive patch or other dressing 42 with the garment removed for clarity of illustration. The catheter 44 is stored when not in use in a compartment 46 of a pocket 48 that is secured to the inside wall of the garment 10. As shown in FIG. 5, which illustrates the inside surface of the front 12 of the garment 10, the pocket 48 includes a bottom edge 48*b* and side edges 48*c* and 48*d*, all of which are secured, for example, by means of stitching 50 to the front wall 12 of the garment 10. In FIGS. 4 and 5, the Hickman catheter 44 is shown in a coiled condition as it appears when concealed within the pocket 48. Spaced above the pocket 48 (FIG. 4) is an opening, in this case a horizontally disposed slit-like opening 52 through which the catheter 44 can be withdrawn when it is to be deployed. The edges of the opening 52 are preferably hemmed and include horizontally disposed, parallel, laterally extending upper and lower hemmed edges 54 and 56 (FIG. 5).

The pocket 48 has a horizontally disposed free upper edge 48a which is spaced below the opening 52 by a predetermined distance 58. For most purposes, the spacing 58 between the opening 52 and the free upper edge 48*a* of the pocket 48 is typically from about ¼ inch to about ½ inches. The spacing 58 enables the healthcare worker or parent to easily reach through the opening 52 and grasp the medical appliance 44, lift it from the compartment 46 within the pocket 48, and withdraw it through the opening 52 which, as can be seen especially in FIG. 4, is unobstructed by any part of the pocket 48. Thus, the invention makes the catheter 44 easy to reach and also facilitates its removal through the opening 52 to a deployed position since no portion of the pocket 48 gets in the way of the opening 52 or the fingers of the healthcare worker when reaching through the opening 52. The healthcare worker can also reach through the opening 52 into the space between the garment 10 and the patient's chest and, if necessary, reach up or down or in either direction from side to side to get a grip on or locate some portion of the medical appliance 40 without the pocket 48 being in the way of the person's fingers.

Figure 8:
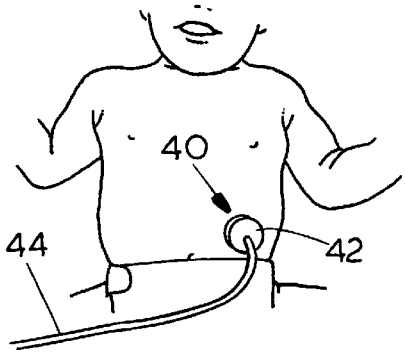
FIG. 8 is another partial front elevational view of a patient showing a medical appliance connected to the patient with the garment removed.

To illustrate another application of the invention, FIG. 8 shows a another medical appliance secured to the abdominal wall of a child with the aid of a plastic disc 42. The appliance in this case is a gastrostomy feeding tube 44, sometimes known as a MICKEY®, that is passed through the abdominal wall on the left side of the patient's body into the stomach. The appliance 44 in this case is secured to the wall of the body with the aid of the plastic supporting disc 42.

Figure 1:
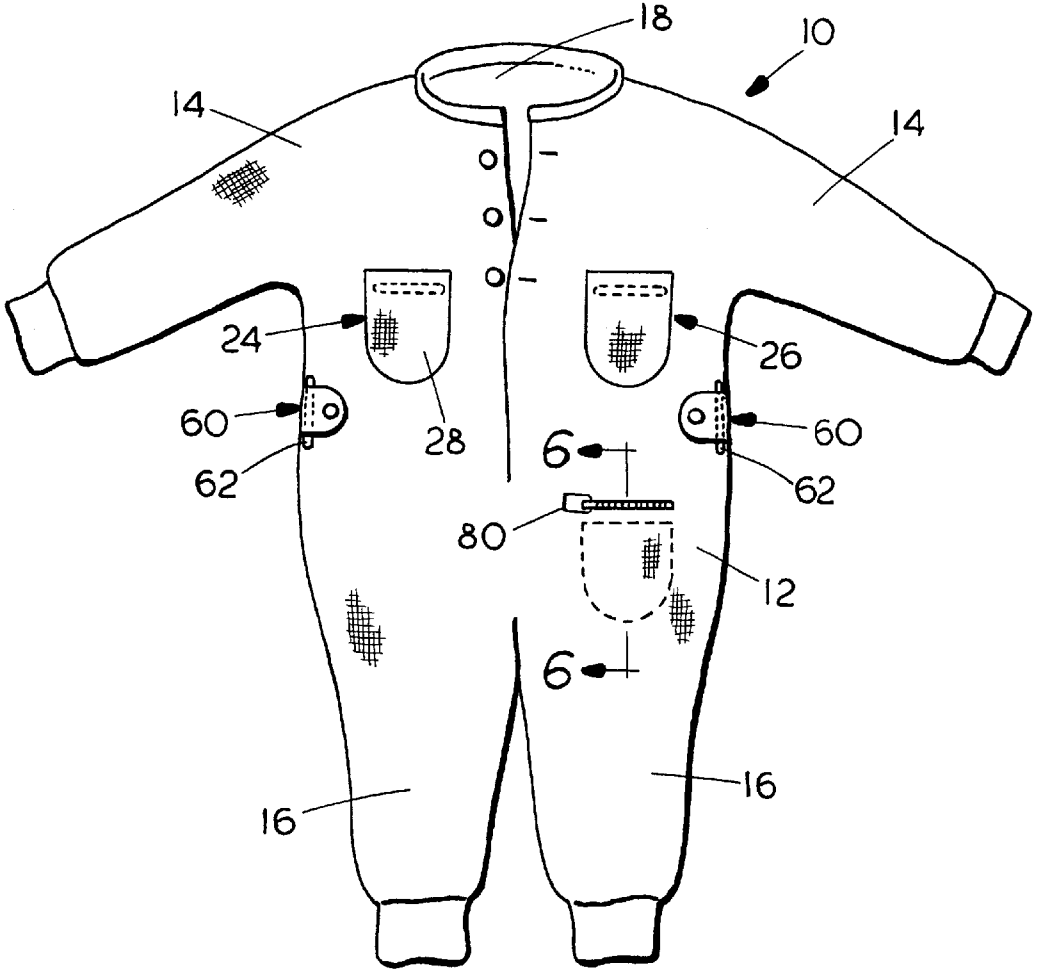
FIG. 1 is a front elevational view of a garment comprising a child's sleeper in accordance with the invention.
Figure 6:
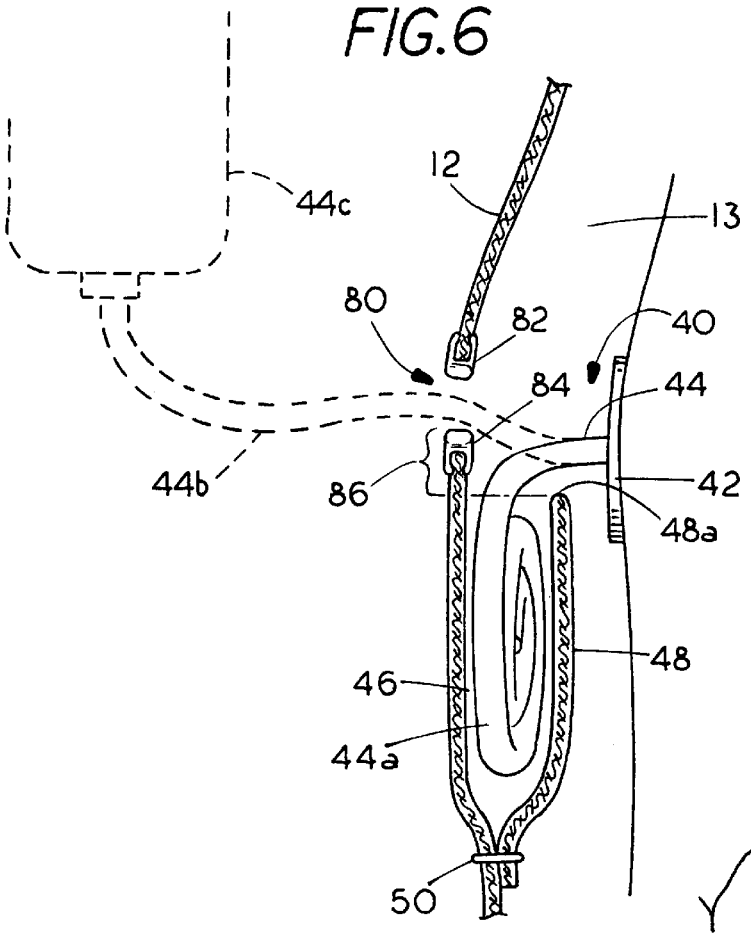
FIG. 6 is a vertical sectional view similar to FIG. 4 of another form of the invention.

Refer now to FIGS. 1 and 6 which illustrates another form of the invention in which the horizontal opening 80 is provided with a horizontally extending zipper that includes zipper teeth 82 and 84 that are secured conventionally to the upper and lower edges of the opening between them. In this case, no flap such as the flap 28 is provided. When the medical appliance is to be deployed, the zipper 80 is opened so as to provide a horizontally extending slit-like opening that is separated by means of vertical spacing 86 above the top edge 48*a* of the pocket 48. Again, the spacing 86 is typically about one-quarter to about one-and-one-half inches, but is most preferably about one-half inch. This enables the healthcare worker to reach easily either into the pocket 48 or into the space 13 between the patient and the front 12 of the garment 10. For purposes of illustration, it will be assumed that the medical appliance 40 in FIG. 6 is a feeding tube 44 which is secured to the patient through a supporting disc 42. When the feeding tube 44 is to be deployed, the opening 80 is unzipped and the healthcare worker can then reach in through the opening into the pocket 48, remove the tube stored at 44*a*, withdraw it as shown at 44*b* and attach it to a drip feeding appliance 44*c* to initiate gastrostomy feeding.

Figure 7:
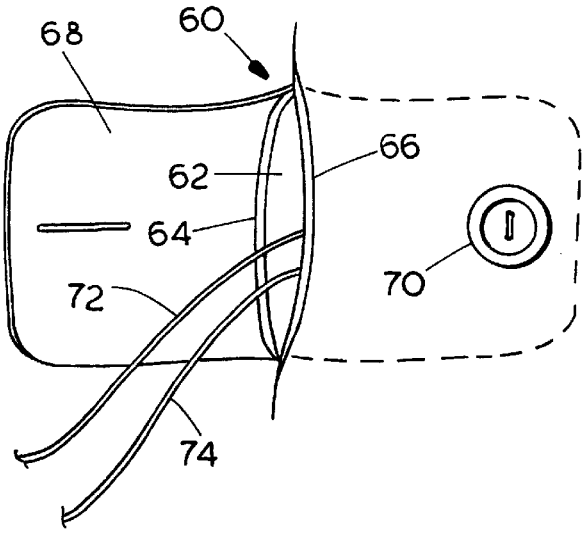
FIG. 7 is a partial front elevational view of another opening that can be used in the garment in accordance with the invention.
Figure 9:
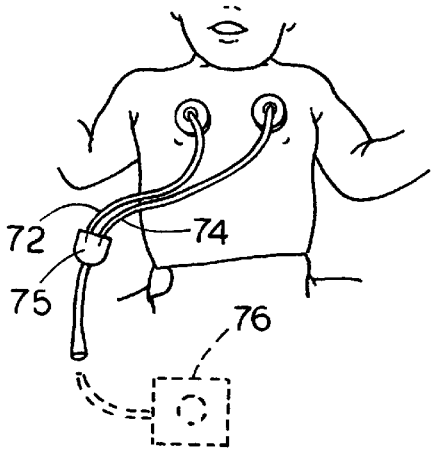
FIG. 9 is a partial front elevational view of another patient showing a pair of medical appliances connected to the patient with the garment removed for clarity.

Refer now to FIGS. 7 and 9 which illustrate another aspect of the invention. In this case, an aperture shown generally at 60 is provided in the garment at a lower elevation, i.e., somewhat below, and typically in the case of an infant about two to six inches below, the pocket assemblies 24 and 26. Each aperture 60 in this case comprises a vertical slit on the side of the garment 10 having vertically disposed edges 64 and 66 with an opening 62 between them that can be covered, except when the opening 62 is in use, by means of a flap 68 that is secured to the front wall of the garment 10 by means of a fastener such as a button 70 that is sewn to the front 12 of the garment 10. The opening 62 can be used at the same time as one of the pocket assemblies 24, 26. Although the opening 62 has general application, it is shown by way of example as an opening for a pair of insulated electrical conductors 72, 74 that are fastened to leads on the patient's chest as shown in FIG. 9. The insulated electrical conductors 72, 74 are withdrawn through the opening 62 and are connected to a plug 75 outside of the garment which is in turn connected to an apnea monitor 76. Thus, while the pocket assemblies 24 and 26 are in use, the opening 60 can also be used simultaneously for other purposes and for other kinds of medical appliances. When not in use, the flap or cover 68 can be secured in a closed position (FIG. 1) by means of the button 70 so that the opening 60 is not apparent.

The invention is useful in connection with a variety of medical appliances such as intravenous for fluid infusion or blood transfusion, for gastrostomy tubes, for central venous catheters for long-term intravenous infusions of blood, medicine or total parenteral nutrition, as well as for electrical conductors used in monitoring vital signs, for apnea monitoring or for heart monitoring.

While a Hickman catheter has been illustrated in FIG. 3, the catheter 44 can comprise any of a variety of catheters such as a Port-A-Cath® which is surgically placed under the skin and accessed for infusion. One example of an infusion catheter is a parenteral catheter for administering glucose solutions. The invention is also useful with a double lumen catheter.

The invention is particularly beneficial for pediatric use, but it is equally useful for adults. It can be used by hospital patients or in clinics or by patients that are in their homes. It is suitable both for day wear as well as for night wear. It is particularly useful as clothing that children wear during the day. It can be used as a top garment or a jumper, i.e. a garment with arm and leg openings but with no pant legs. In addition, it can be used as a child's body suit in which a separate pair of pants is used.

The use of the invention will be described in a typical application with reference to FIGS. 1–5. After the patient has dressed and left the hospital room for a period of time, say two or three hours, it may be necessary to perform an infusion. To carry this out, the flap 28 is raised first. The healthcare worker then reaches through the opening 52, lifts the catheter 44 from the pocket 48, and withdraws it through the opening 52. A cap (not shown) covering the end of the catheter 44 is then taken off and the catheter which has been withdrawn as shown at 44*b* in FIG. 4 is then connected to the infusion device or bag 45 (FIG. 3) in a conventional manner. The infusion is then conducted for from several minutes to several hours or, if chemotherapy is being conducted, infusion can be administered for a matter of days. Following administration of the infusion, the catheter 44 is placed back in the pocket 48 and the flap 28 is then lowered to the closed position. After this is done, the catheter is so inconspicuous that no one observing the patient will know that it is there. The device shown in FIG. 6 is used in a similar manner except that it is only necessary to open the zipper 80 since no flap is present.

The invention provides several other advantages. For example, the flap 28 prevents the patient, especially in the case of children, from having access to the catheter 44. In addition, when the catheter or electrical conductors are not in use, the patient appears perfectly (i.e., "normal") because, with the appliance stored inside the garment, it is not apparent by the person viewing the garment that a medical appliance is connected to the patient. Moreover, the invention is very comfortable and does not interfere with sleeping or ordinary daytime activities of the patient. It is also safer than prior garments since children cannot gain access to the catheter or wire, which in the past they have sometimes pulled out of their bodies. The invention also makes it less likely that the catheter or leads connected to the patient can get caught on furniture or other article outside of the body. In addition, garments in accordance with the invention can be used as ordinary clothing after the child returns from the hospital and is primarily cared for by a parent or no longer needs a medical appliance. It can also be "handed down" to other children that have no medical disability.

Many variations of the present invention within the scope of the appended claims will be apparent to those skilled in the art once the principles described herein are understood.

What is claimed is:

1. A garment for concealing a medical appliance connected to a patient while allowing the appliance to be reached from the outside and withdrawn without removal of the garment, said garment comprising, a flexible garment body formed from cloth or plastic having a back, arm openings, neck opening and a front portion, the garment body includes a hidden pocket on an inside surface of the garment for storing at least one medical appliance, the garment has an access opening extending therethrough, the access opening is constructed and arranged relative to the pocket so that a person can reach in through the opening from outside of the garment, grasp a medical appliance that is stored within the pocket and withdraw an end portion of the medical appliance through the opening to the outside while the other end thereof remains connected to the patient, means for closing the opening when the opening is not in use and the opening is positioned relative to the pocket for enabling a.) a person to reach into the inner hidden pocket through the opening and b.) reach through the opening into a space between the garment and the patient's body in treating the patient.

2. The garment of claim 1 wherein the pocket has connected side and bottom edges and a free upper edge that is aligned in spaced relationship below the opening in the garment such that the medical appliance can be concealed within the pocket while connected to the patient but is accessible when one reaches through the opening and can be lifted manually out of the pocket from outside of the garment and withdrawn to the outside through the opening for being connected to an appliance spaced from the patient.

3. The garment of claim 1 wherein the opening in the garment is provided with a zipper for closing the opening or a flap on an outside surface of the garment to cover the opening.

4. The garment of claim 1 wherein the garment includes a second opening that has a flap to cover the second opening and said flap has a free edge that is secured to the garment by a fastener when the second opening is not in use such that both openings can be used to permit simultaneous deployment of a pair of medical appliances that are connected to the patient.

5. The garment of claim 1 wherein the medical appliance comprises an electrical conductor or a catheter that is connected to the patient.

* * * * *